US006827525B2

(12) United States Patent
Cheramie

(10) Patent No.: US 6,827,525 B2
(45) Date of Patent: Dec. 7, 2004

(54) METHOD AND SYSTEM FOR BUILDING UP LAND IN A WATER-COVERED OR WATER-SURROUNDED AREA

(76) Inventor: Rickey Thomas Cheramie, P.O. Box 141, Golden Meadow, LA (US) 70357

( * ) Notice: Subject to any disclaimer, the term of this patent is extended or adjusted under 35 U.S.C. 154(b) by 0 days.

(21) Appl. No.: 10/349,599

(22) Filed: Jan. 23, 2003

(65) Prior Publication Data

US 2004/0146358 A1 Jul. 29, 2004

(51) Int. Cl.[7] ..... E02B 15/04

(52) U.S. Cl. ..... 405/63; 405/70; 405/74; 405/210

(58) Field of Search ..... 405/60, 63, 70, 405/71, 73, 74, 222, 223, 210

(56) References Cited

U.S. PATENT DOCUMENTS 3,998,060 A * 12/1976 Preus ..... 405/70
4,664,792 A * 5/1987 Fors et al. ..... 210/170
5,102,261 A * 4/1992 Gunderson, III ..... 405/70
5,346,329 A * 9/1994 Goans et al. ..... 405/68
5,893,978 A * 4/1999 Yoda et al. ..... 210/747
6,346,193 B1 * 2/2002 Bauer ..... 210/615
6,485,229 B1 * 11/2002 Gunderson et al. ..... 405/63
6,567,341 B2 * 5/2003 Dreyer et al. ..... 367/1

FOREIGN PATENT DOCUMENTS

WO WO 02/098801 A1 * 12/2002 ..... C02F/3/00

* cited by examiner

*Primary Examiner*—Heather Shackelford
*Assistant Examiner*—Lisa M. Saldano
(74) *Attorney, Agent, or Firm*—Didriksen Law Firm; Ronald J. Ventola, II

(57) ABSTRACT

A system for building up land in a water-covered or water-surrounded area has a plurality of floating boom segments connected end-to-end in an essentially closed shape, each boom segment having a sieve panel with a height approximately equal to the depth of the water in the water-covered area and made from water-permeable, fine-meshed material, and each sieve panel having an anchor segment attached to the lower portion of the sieve panel. The system also includes a sediment source depositing sediment inside the area essentially enclosed by the essentially closed shape formed by the boom segments. Preferably a wasteweir segment is disposed so as to close the essentially closed shape formed by the floating boom segments, the wasteweir segment having an essentially U-shaped orthogonal frame of a height at least about equal to the depth of the water in the water-covered area. The wasteweir segment also includes barriers that attach to the frame.

40 Claims, 6 Drawing Sheets

METHOD AND SYSTEM FOR BUILDING UP LAND IN A WATER-COVERED OR WATER-SURROUNDED AREA

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO SEQUENCE LISTING, TABLE, OR COMPUTER PROGRAM LISTING SUBMITTED ON COMPACT DISK

Not applicable.

BACKGROUND OF THE INVENTION (1) Field of the Invention

The invention relates to the field of building up land in water-covered or water-surrounded areas and more specifically to the field of restoring land in coastal wetlands where erosion has caused land loss.

(2) Description of the Related Art

Coastal wetlands historically have been rich in plant and animal life. This abundance of plant and animal life has made coastal wetlands productive areas for fishing (for fish and shellfish), trapping, and hunting.

Coastal wetlands require a constant supply of sediment so that the process of sedimentation keeps pace with erosion. In a coastal wetland, the land is built up by sedimentation and broken down by erosion. In a stable coastal wetland, these processes are in balance when considered over the long term: land loss through erosion and land gain from sedimentation remain essentially equal. Seasonal or unusual events such as floods or storms may cause erosion and sedimentation to become unbalanced for a time. But in a stable wetland, erosion and sedimentation remain in balance over the long term.

Over at least the last 100 years, human activities have affected the natural balance between erosion and sedimentation in many coastal wetlands. Levees and other developments have reduced the flow of fresh water into many coastal wetlands. These developments have reduced the amount of sedimentation in the affected coastal wetlands by eliminating the sediment flows that were carried by the fresh water flow.

In addition to reducing sedimentation, the reduction of fresh water flow has also promoted erosion. The reduction of fresh water flow has changed the chemical composition—especially the salinity—of water in some coastal wetlands. Plants adapted to the previous (lower) salinity levels often die when salinity increases. Killing the plants increases erosion because many plants hold the land together and help to absorb impacts of waves and other water flows. When the plants die, erosion increases.

With erosion increasing and sedimentation decreasing, land area in coastal wetlands has shrunk. Facing the loss of a valuable resource, public officials and citizens have sought ways to reduce erosion and increase sedimentation in coastal wetlands so that lost land may be restored. Fresh water diversion from rivers into coastal wetlands merely keeps salt water at bay and does little to promote land restoration, not only because of decreased sediment in leveed rivers but also because diversion of fresh water typically uses siphons or pipes that place sediment-containing water into a single location rather than over a broader plain. Rivers currently contain seventy percent less sediment than they did fifty years ago because of flood-prevention methods upstream.

Various devices for building up land in a water-covered area have been disclosed to aid in reducing and reversing land loss. U.S. Pat. No. 6,190,088 to Van Der Hidde et al. discloses a device for forming a sand body. The device comprises a substantially rectangular portion of water-permeable cloth. The cloth is held to the water bottom on three of its four sides by anchors and sediment pouches. The fourth side of the cloth is held above the water bottom by floating elements. The cloth thus forms a water-permeable pouch. Sediment-containing water flow enters the open end of the pouch and is trapped, eventually forming a sand body. Van Der Hidde's device appears to be intended to promote sedimentation by entrapping sediment that is being moved about by natural currents. The device does not appear to be suited for use in areas where no natural sediment-containing flow is available, such as a coastal wetland where former sediment-containing water flows have been reduced or eliminated by levees.

In contrast to Van Der Hidde's cloth pouch, other patents disclose rigid, non-floating barriers intended for use in building up land. U.S. Pat. No. 3,835,651 to Butterworth et al. discloses a rigid, piling-supported barrier for use in building up land. Butterworth's device comprises a system of rigid bulkheads that slow a sediment-charged flow, causing deposition of sediment and the eventual formation of land. Butterworth's device also includes additional bulkheads that prevent erosion by reducing the impact force of waves striking the shore. Butterworth's device appears to be specially adapted for use where wave action is present, such as the shores of lakes and oceans.

Another rigid, piling-supported device is disclosed by U.S. Pat. No. 4,089,179 to Trautman. Trautman discloses a device comprising a rigid, post-supported frame with screened louvers mounted thereon. The device allows waves, which carry sediment, to pass freely toward shore; but it slows flow away from shore, causing sediment to be deposited near the shore. Thus the device causes a sand body to be formed.

U.S. Pat. No. 5,007,766 to Freed et al. discloses a sediment barrier for reducing erosion that occurs when water flows across land. The barrier comprises an array of fibers emanating upward from a foundation; the fibers reduce erosion by reducing the velocity of water that flows through the device.

Several patents disclose floating barriers, but these patents do not disclose the use of the barriers to control erosion or to build up land. For example, U.S. Pat. No. 3,984,987 to Light discloses an apparatus for preventing silt from entering a marine facility and for confining spills of pollutants within the facility. Light's device comprises a floating barrier secured across the opening of the facility and a flexible curtain having means for anchoring the curtain to the floor of the water body. Light discloses that the device may be used to avoid silt buildup in a facility, but Light does not disclose any use of the device to control erosion or to build up land.

Another floating barrier is disclosed by U.S. Pat. No. 4,190,381 to Kraus et al. Kraus discloses that the device may be used for collecting material floating upon the surface of a body of water. The device comprises a plurality of floating elements that are connected to a barrier. The barrier has an upper or freeboard position and a lower or skirt portion extending downward into a body of water. Attached to the barrier's skirt and extending downward therefrom is a lattice containing a plurality of strands made from an extensible material. The lower portion of the lattice is connected to a bottom tension line, which is shorter in length than the corresponding portion of the barrier. Kraus's device is adapted to confine a liquid spill that floats upon a body of water. The device is not adapted for building up land.

U.S. Pat. No. 4,688,024 to Gadde discloses a barrier comprising a floating lift hose, an anchoring body, and a net extending therebetween. Gadde discloses that the device is useful for blocking a water passage or channel against the admission of a foreign or unfamiliar object, such as an underwater vessel, frogman, or the like.

Finally, U.S. Pat. No. 5,927,899 to Claesson discloses an arrangement for a floating body comprising containers made from a flexible material positioned laterally in relation to one another and capable of being filled with air or other gas. The prior art does not disclose or suggest that the floating bodies described therein can be used to confine sediment to build up land in a water-covered or water-surrounded area.

BRIEF SUMMARY OF THE INVENTION

It is an object of this invention to provide a method and system for building up land in a water-covered area. It is another object of this invention to provide a floating structure capable of confining sediment. To achieve these and other advantages and objects, and in accordance with the purpose of the invention as embodied and broadly described herein, in one aspect the inventor describes a method for building up land in a water-covered area.

In a first embodiment, the method includes the steps of: supplying a floating structure having an essentially closed shape and capable of confining sediment; selecting a location in which land is to be built up; placing the floating structure at the location; and introducing a sediment-containing water flow into the interior of the essentially closed shape.

Further in accordance with the purpose of the invention as embodied and broadly described herein, in another aspect, the inventor describes in a system for building up land in a water-covered area. The system includes a plurality of floating boom segments, a wasteweir segment, and a sediment source. The boom segments and the wasteweir segment are connectable to form a shape that encloses an area wherein land is to be built up. The boom segments are connectable by connecting means as described further below. Each boom segment has a body that has a sieve panel attached thereto. Thus the assembled device includes an essentially closed shape formed by the boom segments and interrupted by the wasteweir segment. The assembled device also includes an essentially closed shape extending essentially between the water surface and the water bottom and interrupted by the wasteweir segment. The wasteweir segment enhances the rate of land formation by increasing the rate at which water pumped in by the sediment source may leave the enclosed area. Other embodiments of the invention may include multiple wasteweir segments or may omit wasteweir segments entirely.

In the first embodiment of a system for building up land in a water-covered area, each boom segment has a floatable body having a first end portion, a second end portion, and a lower side portion; a first means for connecting the body attached to the first end portion and a second means for connecting the body attached to the second end portion; and a sieve panel attached to the lower side portion. The floating body is formed from buoyant material and may be formed in any convenient fashion allowing attachment of the sieve panel and the means for connecting the body. In the first embodiment, the floatable body is preferably made from a buoyant foam material. The foam material is preferably sealed within a skin of vinyl cloth. The skin is preferably equipped with grommeted holes for attaching means for connecting the body.

In the first embodiment, the sieve panel of each boom segment is preferably heat-bonded to the vinyl skin of the floatable body. The sieve panel of each boom segment has a generally rectangular shape and an upper portion, a lower portion, and first and second side portions, the first and second side portions of the sieve panel being respectively aligned with the first and second end portions of the body. Each first side portion of the sieve panel has disposed thereon a first means for connecting sieve panel; likewise, each second side portion of the sieve panel has disposed thereon second means for attaching sieve panel. In the first embodiment the means for connecting sieve panels are two connectible portions of a zipper. Other means, including ropes, cords, snaps, interlocking rigid connectors, and heat bonding, may also be used as sieve-panel connecting means. Each sieve panel has a height greater than or approximately equal to the depth of the water in the water-covered area and preferably has a height approximately twice the depth of the water in the water-covered area in order to create a terracing effect around the perimeter and to thereby mimic a naturally-sloped shoreline. Here the height of a sieve panel is the distance between its upper portion and its lower portion, measured with the sieve panel laid out upon a flat surface. When the sieve panel has a height greater than the depth of the water in which the sieve panel is used, the fact that the height of the sieve panel itself is greater that the water depth allows the sieve to bulge outward in a curved shape; for example, see FIG. 7.

In a preferred embodiment, the mesh of the sieve panel is approximately 1/16 inch. This allows for vegetation to take root and be anchored to the sieve panel.

Optionally, each sieve panel has an anchor segment attached to and preferably running the length of its lower portion, the anchor segment being a segment of lead-core line, chain, or other similar dense, non-floating, generally linear material. The anchor segment helps to hold the lower portion of the sieve panel to the bottom of the water-covered area. Each boom segment has an anchor segment having a first end portion aligned with the first end portion of the floatable body and a second end portion aligned with the second end portion of the floatable body. Each anchor segment has first anchor connecting means disposed upon the first end portion thereof and second anchor connecting means disposed upon the second end portion thereof.

Optionally, each boom segment can also include a tiedown having a first end portion and a second end portion, the first end portion being attached to the body. The tiedown is secured so that its length under tension is approximately equal to the depth of the water and the length of the tiedown is at least approximately equal to the depth of the water. Preferably, the tiedown is fastened to the anchor line such that its length approximately equals the depth of the water. Tiedowns are intended to add strength to the boom segments and to keep the boom segments at the height of the wasteweir.

In the first embodiment the wasteweir segment is an essentially U-shaped frame having a height at least approximately equal to the depth of the water in the water-covered area. The frame is constructed so that it is denser than water. Aluminum, steel, or other appropriate materials can be used for the frame material. The wasteweir segment includes a first wasteweir-to-body connecting means allowing it to be connected to the second body-connecting means and a second wasteweir-to-body connecting means allowing it to be connected to the first body-connecting means. The wasteweir segment also includes means for connecting it to the first and second sieve-panel attaching means. The wasteweir segment also includes wasteweir-to-anchor connecting means disposed thereon to allow for connection to the anchor segments of boom segments adjacent to the wasteweir segment. By use of its various connecting means, the wasteweir segment may be inserted and connected as part of an assembly of boom segments. The wasteweir segment also includes barriers, which in the first embodiment are preferably ordinary wooden boards. The barriers are connectible to the wasteweir frame via barrier receiving means, which are grooves in the wasteweir frame as in the second embodiment.

The first embodiment also has a sediment source disposed so as to provide sediment flow into the interior of the closed shape formed by the boom segments and the wasteweir segment. The sediment source in the first embodiment is preferably the discharge of a dredge.

In an alternative embodiment, the sieve panel of each boom segment does not have an anchor line attached thereto. Instead, a single anchor line of the desired length is attached to the sieve panels, to the tiedowns of each segment, and to the wasteweir segment, thus running the length of the device.

Both the foregoing general description and the following detailed description are exemplary and explanatory only and do not restrict the invention as claimed.

The invention will be better understood in view of the following description presented with reference to the accompanying drawings:

DETAILED DESCRIPTION OF THE INVENTION

Figure 6:
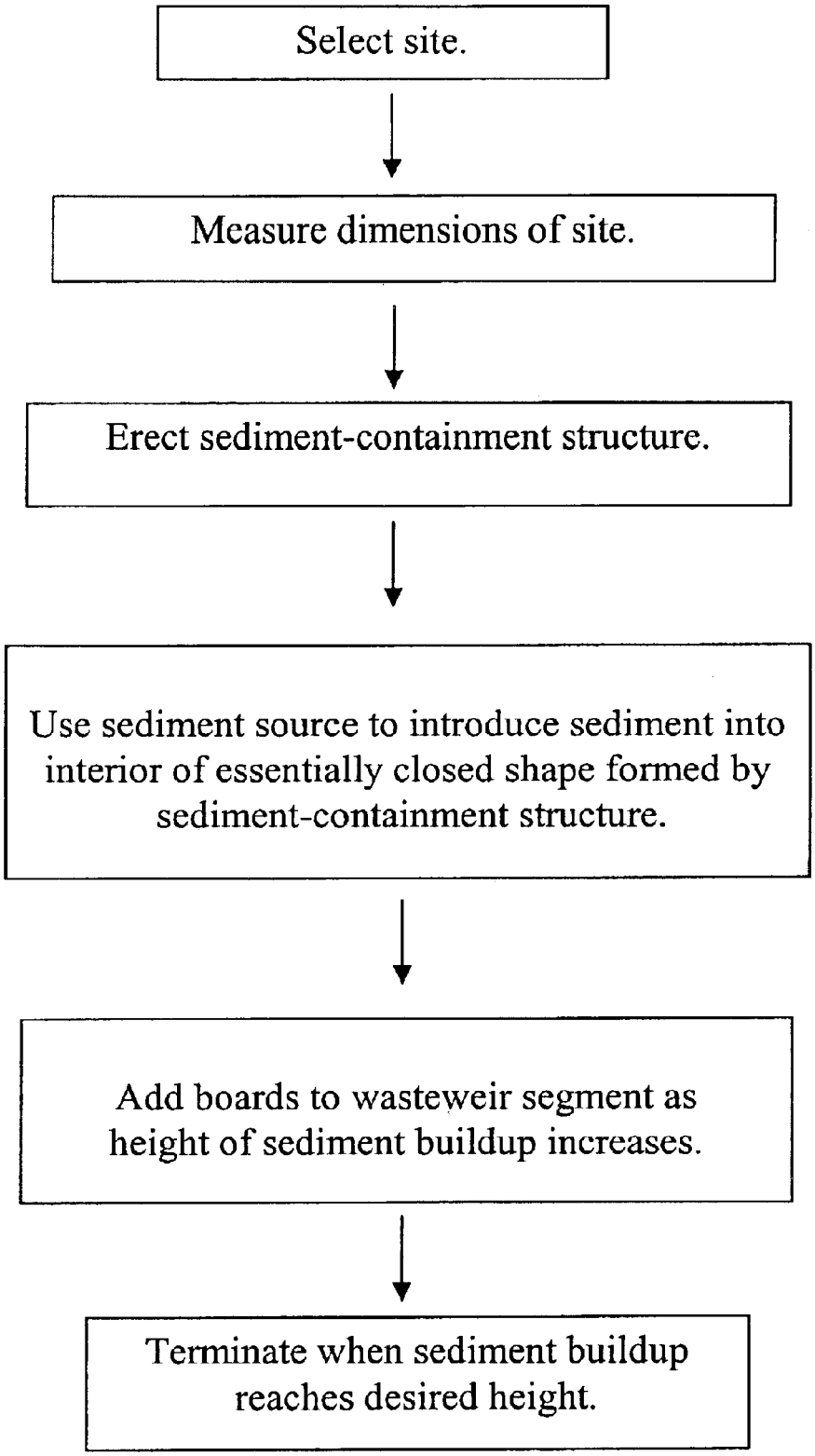
FIG. 6 is a flow chart showing the steps, the steps being those which one embodiment of the method of the invention comprises.
Figure 7:
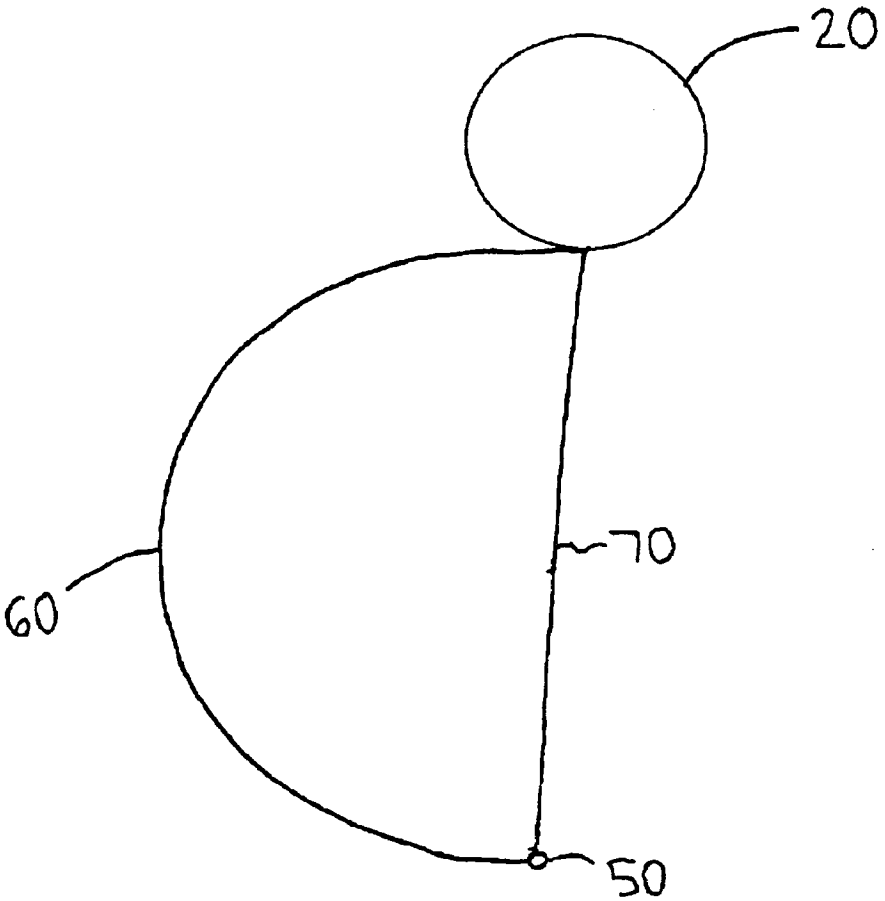
FIG. 7 is a sectional view of an embodiment of the invention shown in FIG. 2, taken along section D—D thereof.

The inventor now moves to a detailed description of a second embodiment of the method of the invention, which is shown in the drawings, where like parts are labeled with like reference numerals. FIG. 6, is a flow chart depicting the steps that are involved in the second embodiment, which is depicted therein.

1. Select a site where the method will be practiced. The site is typically a coastal marsh or wetland that has been eroded through a process that includes salt-water intrusion. Islands that have been degraded due to erosion can also be selected.
2. Measure the dimensions of the site including the depth of the water contained at various locations around the site.
3. Erect a sediment-containment structure explained in the manner described below.
4. Introduce sediment into the substantially closed shape formed by the sediment-containment structure.

Additionally, board or other blocking means can be added to a wasteweir segment as the height of sediment buildup increases.

The inventor now moves to a detailed description of a second embodiment of the system of the invention, which is shown in the drawings, where like parts are labeled with like reference numerals. In FIGS. 1 through 5, system 10 for building up land in a water-covered area includes boom segments 20, wasteweir segment 80, and dredge discharge 500, which discharges sediment-containing flow 520 inside the closed shape formed by the assembly of boom segments 20 and wasteweir segment 80.

Figure 1:
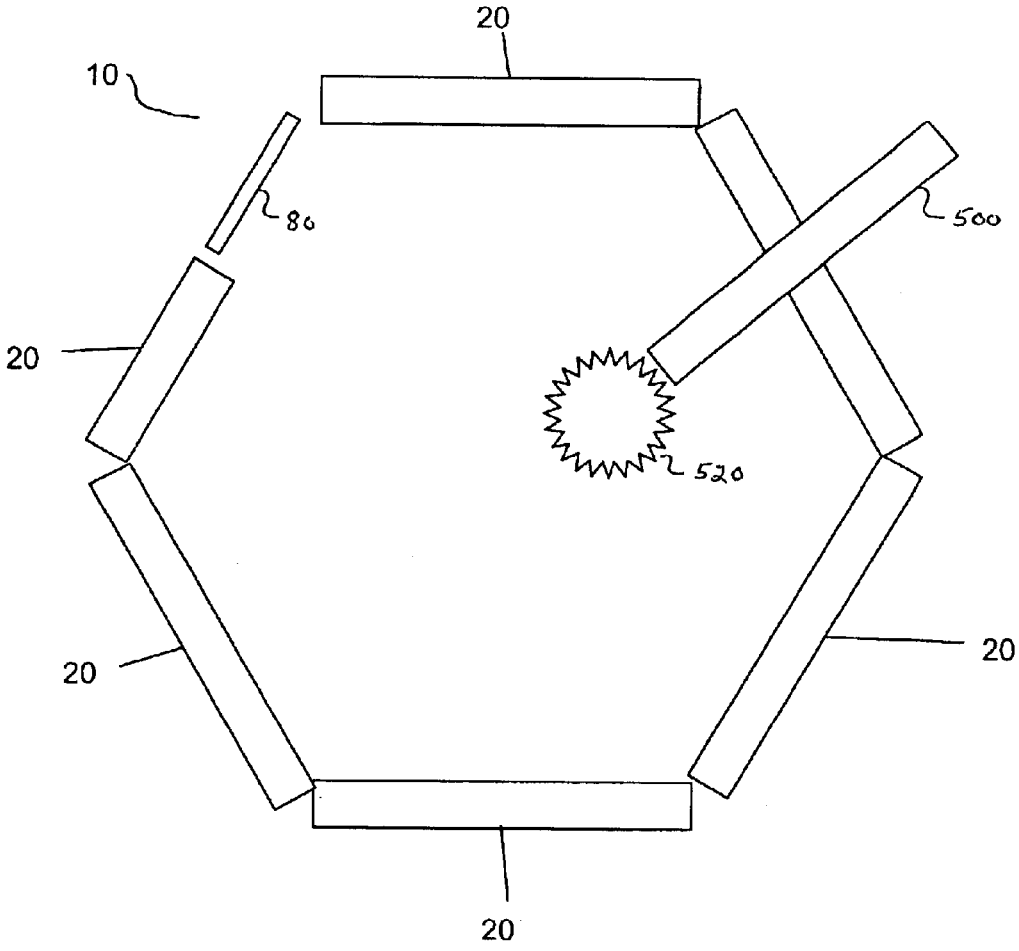
FIG. 1 is a top view showing an embodiment of the invention, including the assembled components thereof.
Figure 2:
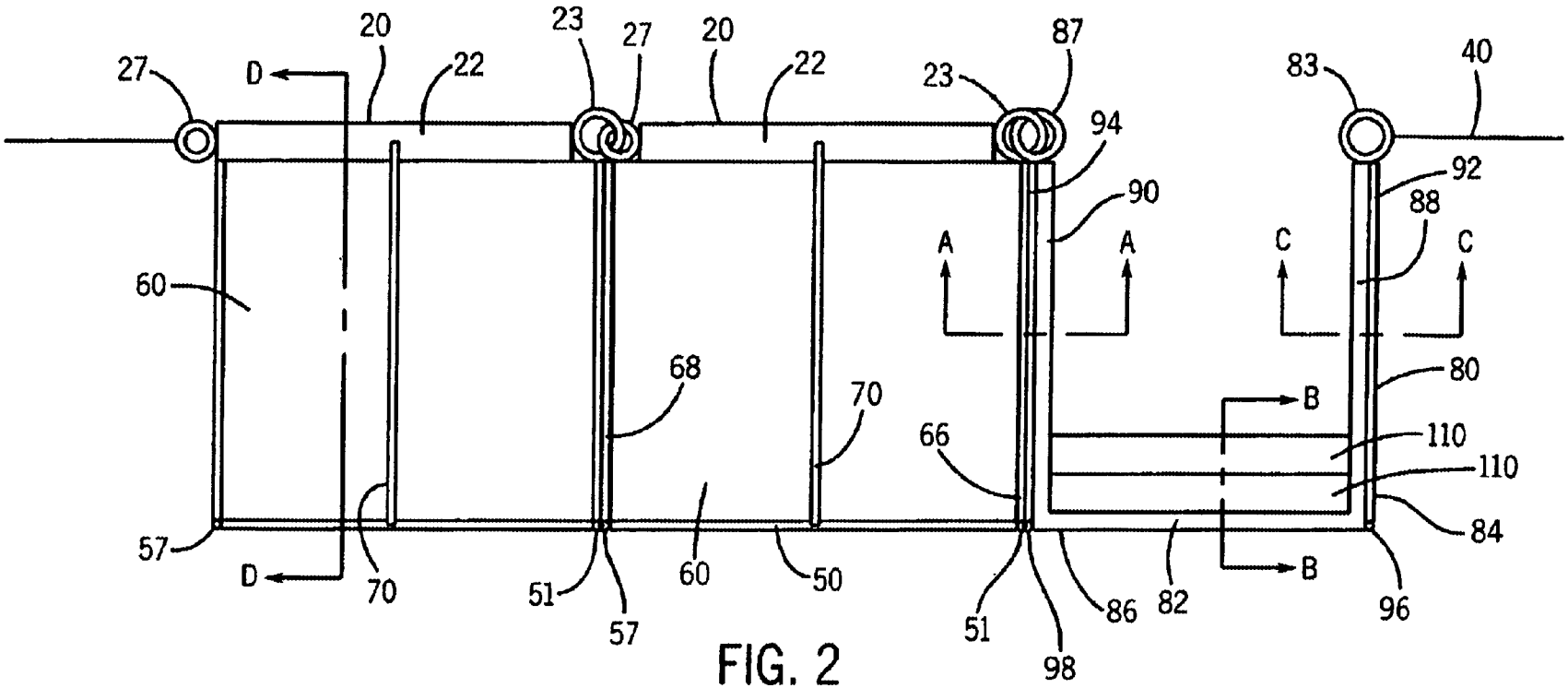
FIG. 2 is a partial side view of an embodiment of the invention.
Figure 4:
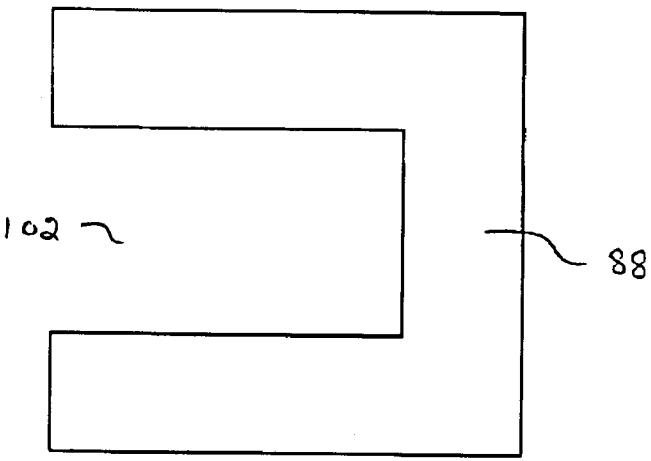
FIG. 4 is a view of the frame of the wasteweir segment depicted in FIG. 2, taken along sections C—C of FIG. 2.
Figure 3:
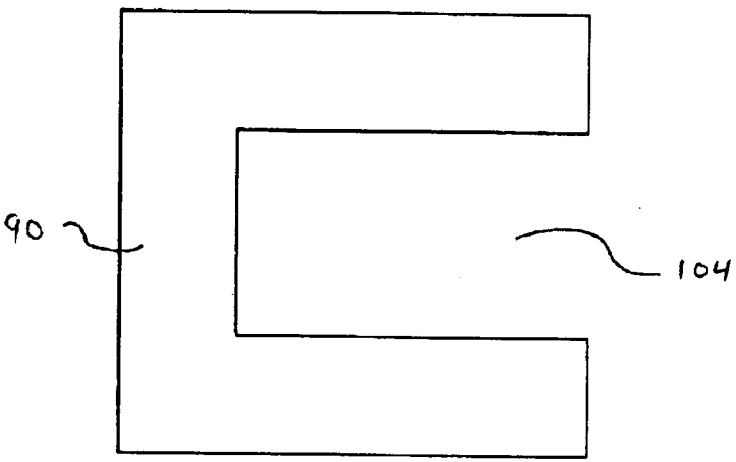
FIG. 3 is a view of the frame of the wasteweir segment depicted in FIG. 2, taken along sections A—A of FIG. 2.
Figure 5:
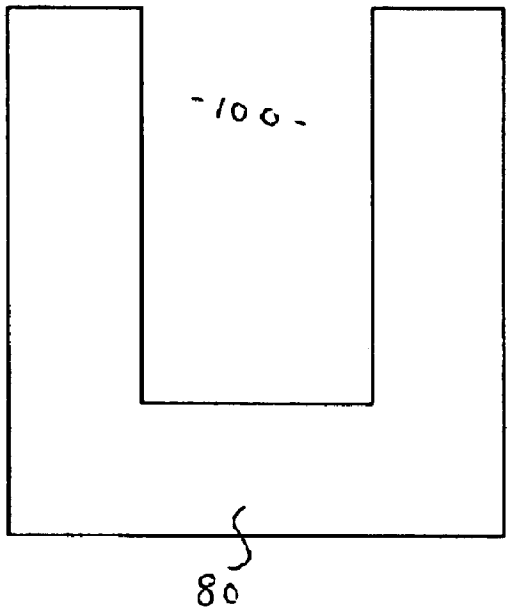
FIG. 5 is a view of the frame of the wasteweir segment depicted in FIG. 2, taken along sections B—B of FIG. 2.

FIG. 2 is a partial side view of the system 10 in use, with floatable bodies 22 of boom segments 20 floating upon water surface 40. In this embodiment, each floatable body segment is preferably constructed from a buoyant foam material that has a waterproof vinyl skin. Each boom segment 20 has first body-connecting means 23, for connecting one boom segment to an adjacent boom segment, and second body-connecting means 27 for the same purpose. Means 23 and 27 are disposed on opposite end portions of a boom-segment 20. The first body-connecting means 23 is connectible to the second body-connecting means 27 for connecting adjacent segments 20. These body-connecting means are rings in the depicted embodiment, but they may be any suitable known connecting means including ropes, straps, rings, hooks, and interlocking rigid connectors. The connectors may be attached to the floating body by any convenient means, including fixation with adhesives, heat-bonding, or passing the connectors through grommeted perforations in the vinyl skin of the floating body.

In the embodiment depicted in the figures of the drawing, each boom segment 20 also has attached, to its lower side portion, sieve panel 60. Sieve panel 60 has an upper portion, a lower portion, and first and second side portions aligned with the first and second end portions 23 and 27, respectively, of body 22. Sieve panel 60 is made from a mesh or cloth having a weave sufficiently tight to trap a significant portion of the sediment carried by a water flow passing through the mesh and potentially sized so as to allow roots to attach or anchor to or through the sieve panel. Sieve panel 60 has first means 66 for connecting sieve panel 60 disposed upon its first side portion and second means 68 for connecting sieve panel disposed upon its second side portion. Each sieve panel 60 is connected by its first means 66 for connecting sieve panel to an adjacent sieve panel 60 or to an adjacent wasteweir segment 80; each sieve panel 60 is connected by its second means 68 for connecting the sieve panel to an adjacent sieve panel 60 or to an adjacent wasteweir segment 80. The first means 66 and second means 68 for connecting sieve panels may be any suitable connecting device, including two compatible portions of a zipper; a row of eyelets for securing with cord or rope, or even the mesh itself, through which a securing cord, thread, staple, or other device may be looped, woven, or otherwise secured.

Each boom segment has anchor segment 50, which is attached to the lower portion of the sieve panel 60. Anchor segment 50 is made from a dense material (at least denser than water) such as lead-core line or heavy chain. Anchor segment 50 secures the device to the bottom of the water-covered area in order to prevent unwanted movement. Each anchor segment 50 has first anchor-connecting means 51 aligned with first body-connecting means 23 and second anchor-connecting means 57 aligned with second body-connecting means 27. These first and second anchor-connecting means may be any suitable known connecting means, including those listed for use as body-connecting means. Alternatively, a single, continuous anchor segment can be used to anchor all of the sieve panels.

Each boom segment 20 has tiedown 70 having first and second end portions. The first tiedown end portion is attached to body 22, and the second tiedown end portion is attached to anchor segment 50. Tiedown 70 has a length approximately equal to the depth of the water.

Wasteweir segment 80 is a three-sided frame having a base 82 having first end portion 84 and second end portion 86 and having first side element 88 and second side element 90 joined in substantially perpendicular relation to base 82. First side element 88 has first body-wasteweir connecting means 83 attached near the end thereof most remote from base 82; second side element 90 has second body-wasteweir connecting means 87 attached near the end thereof most remote from base 82.

First body-wasteweir connecting means 83 is a connector connectible to second body-connecting means 27. Second body-wasteweir connecting means 87 is a connector connectible to first body-connecting means 23. In addition, the first end portion of base 82 has attached thereto first wasteweir-anchor connecting means 96 and second wasteweir-anchor connecting means 98. First wasteweir-anchor connecting means 96 is connectible to second anchor-connecting means 57, and second wasteweir-anchor connecting means 98 is connectible to first anchor-connecting means 51.

Wasteweir first side 88 has attached thereto first wasteweir-sieve connecting means 92; second wasteweir side 90 has attached thereto second wasteweir-sieve connecting means 94. First wasteweir-sieve connecting means 92 is connectible to second sieve-panel connecting means 68. Second wasteweir-sieve connecting means 94 is connectible to first means sieve-panel connecting means 66.

The frame of wasteweir segment 80 includes longitudinal opening 100 in base 82, longitudinal opening 102 in first side 88, and longitudinal opening 104 in second side 90, each longitudinal opening being a groove adapted for receiving a board 110. These longitudinal openings constitute the barrier receiving means of this embodiment of the invention. Other barrier-receiving means would include pegs to which barriers might be affixed, magnets, rigid interlocking connectors, and holes with screws or bolts allowing the barriers to be screwed or bolted to the frame. Barriers 110 are preferably wooden boards fitted into the wasteweir segment as the level of built-up land rises in order to contain sediment while allowing for a rapid discharge of water from the water-covered area.

I claim:

1. A system for building up sediment in a water-covered area, comprising:

(A) a plurality of boom segments connected end-to-end in an essentially closed shape, each boom segment comprising:

(i) a floatable body having a first end portion, a second end portion, and a lower side portion;

(ii) a first body-connecting means attached to the first end portion of the body;

(iii) a second body-connecting means attached to the second end portion of the body;

(iv) a sieve panel having an upper portion, a lower portion, and first and second side portions, the sieve panel being attached along its upper portion to the body with the first and second side portions of the sieve panel being respectively aligned with the first and second end portions of the body and the sieve panel having a first sieve-panel connecting means disposed upon the first side portion and a second sieve-panel connecting means disposed upon the second side portion, the sieve panel having a height greater than or approximately equal to the depth of the water in the water-covered area and the sieve being made from water-permeable, fine-meshed material; wherein the first body-connecting means of each segment is connected to the second body-connecting means of an adjacent segment, and the first sieve-panel connecting means of each sieve panel is connected to the second sieve-panel connecting means of an adjacent sieve panel;

(B) a sediment source depositing sediment inside the area substantially enclosed by the essentially closed shape formed by the boom segments; and (C) a wasteweir segment disposed so as to close the substantially closed shape formed by the floating boom segments, the wasteweir segment comprising:

(i) an essentially orthogonal frame, the height of the frame being at least about equal to the depth of the water in the water-covered area, the frame having a first side portion, a second side portion, and a base having first and second end portions, the first side portion having a lower end portion attached to the first end portion of the base and a second side portion having a lower end portion attached to the second end portion of the base, the frame having disposed upon the top portion of its first side portion a first wasteweir-body connecting means and having disposed upon the top portion of its second side portion a second wasteweir-body connecting means, the first side portion having disposed thereon a first wasteweir-sieve connecting means, and the second side portion having disposed thereon a second wasteweir-sieve connecting means, and a barrier receiving means; the wasteweir segment being connected by the first wasteweir-body connecting means to the second body-connecting means of a first boom segment and being connected by the second wasteweir-body connecting means to the first body-connecting means of a second boom segment, the wasteweir segment being disposed so that it closes the substantially closed shape formed by the floating boom segments; and (ii) a barrier element adapted to be engaged by the barrier receiving means of the wasteweir segment.

2. The system as claimed in claim 1, wherein each boom segment further comprises an anchor segment attached to the lower portion of the sieve panel, the anchor segment having a first end portion aligned with the first end portion of the body and a second end portion aligned with the second end portion of the body, the anchor segment having first anchor-connecting means attached to the first end portion and second anchor-connecting means attached to second end portion, the first end portion of each anchor segment being connected the second end portion of an adjacent anchor segment, and wherein the frame of the wasteweir segment has first wasteweir-anchor connecting means disposed upon the first end portion of the base and second wasteweir-anchor connecting means disposed upon the second end portion of the base, and wherein the second wasteweir-anchor connecting means of the wasteweir is attached to first anchor-connecting means of a first boom segment and the first wasteweir-anchor connecting means of the wasteweir is attached to the second anchor-connecting means of a second boom segment.

3. The system as claimed in claim 2, wherein each boom segment further comprises a tiedown having a first end portion and a second end portion, the first end portion being attached to the body and the second end portion being attached to the anchor segment of the floating boom segment.

4. The system as claimed in claim 3, wherein the length of the tiedowns under tension is approximately equal to the depth of the water in the water-covered area.

5. The system as claimed in claim 4, wherein the first sieve-panel connecting means and the second sieve-panel connecting means of each boom segment are connectable portions of a zipper.

6. The system as claimed in claim 5, wherein the sediment source is the discharge of a dredge.

7. The system as claimed in claim 6, wherein the water-permeable, fine-meshed material has an average mesh size of about 1/16 inches as measured across the greatest width of the mesh openings.

8. The system as claimed in claim 3, wherein the sediment source is the discharge of a dredge.

9. A device as claimed in claim 2, wherein the anchor segment is a segment of lead-core line.

10. A device as claimed in claim 2, wherein the anchor segment is a segment of chain.

11. The system as claimed in claim 1 or claim 2, wherein the water-permeable, fine-meshed material has an average mesh size of about 1/16 inches as measured across the greatest width of the mesh openings.

12. The system as claimed in claim 1, further comprising an anchor line attached to the lower portion of the sieve panels of the boom segments, the anchor line running continuously along the perimeter of the essentially closed shape formed by the boom segments.

13. The system as claimed in claim 12, wherein each boom segment further comprises a tiedown having a first end portion and a second end portion, the first end portion being attached to the body and the second end portion being attached to the anchor line.

14. A device as claimed in claim 12, wherein the anchor line is a lead-core line.

15. A device as claimed in claim 12, wherein the anchor line is a chain.

16. The system as claimed in claim 12, wherein the sediment source is the discharge of a dredge.

17. The system as claimed in claim 1, wherein the sediment source is the discharge of a dredge.

18. The system as claimed in claim 17, wherein the height of a sieve panel is at least about twice the depth of the water in the water-covered area.

19. The system as claimed in claim 17, wherein the water-permeable, fine-meshed material has an average mesh size of about 1/16 inches as measured across the greatest width of the mesh openings.

20. A method for building up land in a water-covered or water-surrounded area, comprising:

(1) providing a sediment-containment structure comprising (A) a plurality of boom segments connected end-to-end in an essentially closed shape, each boom segment comprising:

(i) a floatable body having a first end portion, a second end portion, and a lower side portion;

(ii) a first body-connecting means attached to the first end portion of the body;

(iii) a second body-connecting means attached to the second end portion of the body;

(iv) a sieve panel having an upper portion, a lower portion, and first and second side portions, the sieve panel being attached along its upper portion to the body with the first and second side portions of the sieve panel being respectively aligned with the first and second end portions of the body and the sieve panel having a first sieve-panel connecting means disposed upon the first side portion and a second sieve-panel connecting means disposed upon the second side portion, the sieve panel having a height greater than or approximately equal to the depth of the water in the water-covered area and the sieve being made from water-permeable, fine-meshed material; wherein the first body-connecting means of each segment is connected to the second body-connecting means of an adjacent segment, and the first sieve-panel connecting means is connected to the second sieve-panel connecting means of an adjacent sieve panel;

(B) a wasteweir segment disposed so as to close the substantially closed shape formed by the floating boom segments, the wasteweir segment comprising:

(i) an essentially orthogonal frame, the height of the frame being at least about equal to the depth of the water in the water-covered area, the frame having a first side portion, a second side portion, and a base having first and second end portions, the first side portion having a lower end portion attached to the first end portion of the base and a second side portion having a lower end portion attached to the second end portion of the base, the frame having disposed upon the top portion of its first side portion a first wasteweir-body connecting means and having disposed upon the top portion of its second side portion a second wasteweir-body connecting means, the first side portion having disposed thereon a first wasteweir-sieve connecting means, and the second side portion having disposed thereon a second wasteweir-sieve connecting means, and a barrier receiving means; the wasteweir segment being connected by the first wasteweir-body connecting means to the second body-connecting means of a first boom segment and being connected by the second wasteweir-body connecting means to the first body-connecting means of a second boom segment, the wasteweir segment being disposed so that it closes the substantially closed shape formed by the floating boom segments; and (ii) a barrier element adapted to be engaged by the barrier receiving means of the wasteweir segment; and (2) erecting the sediment-containment structure: and (3) introducing sediment from a sediment source into the closed shape formed by the sediment-containment structure.

21. The method as claimed in claim 20, wherein each boom segment further comprises an anchor segment attached to the lower portion of the sieve panel, the anchor segment having a first end portion aligned with the first end portion of the body and a second end portion aligned with the second end portion of the body, the anchor segment having first anchor-connecting means attached to the first end portion and second anchor-connecting means attached to second end portion, the first end portion of each anchor segment being connected the second end portion of an adjacent anchor segment, and wherein the frame of the wasteweir segment has first wasteweir-anchor connecting means disposed upon the first end portion of the base and second wasteweir-anchor connecting means disposed upon the second end portion of the base, and wherein the second wasteweir-anchor connecting means of the wasteweir is attached to first anchor-connecting means of a first boom segment and the first wasteweir-anchor connecting means of the wasteweir is attached to the second anchor-connecting means of a second boom segment.

22. The method as claimed in claim 21, wherein each boom segment further comprises a tiedown having a first end portion and a second end portion, the first end portion being attached to the body and the second end portion being attached to the anchor segment of the floating boom segment.

23. The method as claimed in claim 22, wherein the length of a tiedown under tension is approximately equal to the depth of the water in the water-covered area.

24. The method as claimed in claim 23, wherein the first sieve-panel connecting means and the second sieve-panel connecting means of each boom segment are connectable portions of a zipper.

25. The method as claimed in claim 24, wherein the sediment source is the discharge of a dredge.

26. The method as claimed in claim 25, wherein the water-permeable, fine-meshed material has an average mesh size of about 1/16 inches as measured across the greatest width of the mesh openings.

27. The method as claimed in claim 22, wherein the sediment source is the discharge of a dredge.

28. A device as claimed in claim 21, wherein an anchor segment is a segment of lead-core line.

29. A device as claimed in claim 21, wherein an anchor segment is a segment of chain.

30. The method as claimed in claim 21, wherein the water-permeable, fine-meshed material has an average mesh size of about 1/16 inches as measured across the greatest width of the mesh openings.

31. The method as claimed in claim 20, further comprising an anchor line attached to the lower portion of the sieve panels of the boom segments, the anchor line running continuously along the perimeter of the essentially closed shape formed by the boom segments.

32. The method as claimed in claim 31, wherein each boom segment further comprises a tiedown having a first end portion and a second end portion, the first end portion being attached to the body and the second end portion being attached to the anchor line.

33. A device as claimed in claim 31, wherein the anchor line is a lead-core line.

34. A device as claimed in claim 31, wherein the anchor line is a chain.

35. The method as claimed in claim 31, wherein the sediment source is the discharge of a dredge.

36. The method as claimed in claim 20, wherein the sediment source is the discharge of a dredge.

37. The method as claimed in claim 36, wherein the height of a sieve panel is at least about twice the depth of the water in the water-covered area.

38. The method as claimed in claim 36, wherein the water-permeable, fine-meshed material has an average mesh size of about 1/16 inches as measured across the greatest width of the mesh openings.

39. The method as claimed in claim 20, wherein the water-permeable, fine-meshed material has an average mesh size of about 1/16 inches as measured across the greatest width of the mesh openings.

40. The method as claimed in any one of claims 20, 21, 22, 31, 32, 36, 37, 23, 24, 33, 34, 28, 29, 27, 35, 25, 39, 30, 38, and 26, further comprising the step of measuring the dimensions of the site where the method is to be performed.

* * * * *